US009536506B1

(12) United States Patent
Melhart et al.

(10) Patent No.: US 9,536,506 B1
(45) Date of Patent: Jan. 3, 2017

(54) LIGHTED DRUM AND RELATED SYSTEMS AND METHODS

(71) Applicant: JIM MELHART PIANO AND ORGAN COMPANY, McAllen, TX (US)

(72) Inventors: Jimmie Ray Melhart, McAllen, TX (US); Samuel David Eanes, McAllen, TX (US)

(73) Assignee: Jim Melhart Piano and Organ Company, McAllen, TX (US)

( * ) Notice: Subject to any disclaimer, the term of this patent is extended or adjusted under 35 U.S.C. 154(b) by 0 days.

(21) Appl. No.: 14/619,559

(22) Filed: Feb. 11, 2015

Related U.S. Application Data

(60) Provisional application No. 61/938,871, filed on Feb. 12, 2014, provisional application No. 62/026,845, filed on Jul. 21, 2014.

(51) Int. Cl.
*A63J 17/00* (2006.01)
*G10D 13/02* (2006.01)
*F21S 4/00* (2016.01)

(52) U.S. Cl.
CPC *G10D 13/02* (2013.01); *F21S 4/00* (2013.01)

(58) Field of Classification Search
CPC ..... G10D 13/02; F21S 4/00
USPC ..... 84/464 R, 464 A
See application file for complete search history.

(56) References Cited

U.S. PATENT DOCUMENTS 4,091,706 A 5/1978 Ludwig
4,353,008 A 10/1982 Dorfman
5,280,742 A * 1/1994 Vergara ..... F21V 23/04 84/411 R
5,461,188 A 10/1995 Drago et al.
5,509,343 A 4/1996 Hsu
5,728,960 A 3/1998 Sitrick
5,922,981 A * 7/1999 Ballister ..... A63J 17/00 84/464 A
D417,689 S 12/1999 Katz
6,399,869 B1 * 6/2002 Sagastegui ..... G10H 1/0016 84/104
6,404,409 B1 6/2002 Solomon
7,129,405 B2 * 10/2006 Moffatt ..... G10H 1/0058 84/477 R
7,227,075 B2 * 6/2007 Chang ..... G10H 1/0008 340/815.46
7,604,378 B2 10/2009 Wolf et al.
(Continued)

*Primary Examiner* — Jeffrey Donels
(74) *Attorney, Agent, or Firm* — Dykema Gossett P.L.L.C.

(57) ABSTRACT

A lighted drum or other article may have a LED strip light and a wireless receiver/decoder in communication with the LED strip light. The wireless receiver/decoder may be configured to receive wireless control signals from a remote computer and control operation of the LED strip light in response to the control signals. Some embodiments may include a trigger assembly engaged with a drum head; a wireless receiver/decoder in communication with the trigger assembly; and at least one LED strip light in communication with the wireless receiver/decoder. The trigger assembly may be configured to generate a trigger signal in response to movement of the drum head. The wireless receiver/decoder may be configured to receive the trigger signal and wireless control signals and control operation of the at least one LED strip light in response to the trigger signal and the control signals. Related systems and methods are also described.

14 Claims, 5 Drawing Sheets

(56) References Cited

U.S. PATENT DOCUMENTS

| | | | | |
|---|---|---|---|---|
| 8,292,484 | B2 | 10/2012 | Cohen | |
| 8,497,418 | B2 * | 7/2013 | Roderick | G10H 3/143 84/464 A |
| 8,697,977 | B1 * | 4/2014 | Lysaght | G10H 1/0016 84/464 A |
| 2003/0234914 | A1 | 12/2003 | Solomon | |
| 2010/0105326 | A1 * | 4/2010 | Hsien | G10H 3/146 455/41.2 |
| 2013/0063042 | A1 * | 3/2013 | Bora | H05B 33/0863 315/292 |
| 2014/0260905 | A1 * | 9/2014 | Lillard | G09B 15/00 84/484 |
| 2015/0009417 | A1 * | 1/2015 | Jargiello, III | F21V 33/0056 348/789 |

* cited by examiner

LIGHTED DRUM AND RELATED SYSTEMS AND METHODS

CROSS-REFERENCE TO RELATED APPLICATIONS

This application claims priority to U.S. Provisional Patent Application No. 61/938,871 filed Feb. 12, 2014, and U.S. Provisional Patent Application No. 62/026,845 filed Jul. 21, 2014, the disclosure of each of which is incorporated herein by reference.

COPYRIGHT NOTICE

This application contains material that is subject to copyright protection. Such material may be reproduced exactly as it appears in Patent and Trademark Office patent files or records. The copyright owner otherwise reserves all rights to such material.

FIELD

This application relates generally to the field of musical drums, and more specifically to apparatus, systems, and methods involving the use of lighted drums to achieve dramatic or theatrical effects.

BACKGROUND

Marching bands and other performing arts groups often have drummers who play various drums carried by the drummers. In addition to the sounds produced by the drums, the drummers often march in various formations to create a visual effect that adds another dimension to the musical performance. However, the drums used in such performances generally have not included a suitable lighting feature.

SUMMARY

A lighted drum may have one or more LED strip lights disposed on or in the drum. A wireless receiver/decoder and battery may be provided on or in the drum or a carrier on which the drum is removably mounted. The battery may be in electrical communication with the LED strip lights and the wireless receiver/decoder. The wireless receiver/decoder may be configured to receive wireless control signals from a remote computer and control operation of the LED strip lights in response to the control signals. The remote computer may be configured to control the operation of LED strip lights on one or more drums carried by one or more drummers.

In some embodiments, one or more sensors and a transmitter may be disposed on or in the drums and/or a carrier for carrying the drums. The one or more sensors may be configured for sensing one or more conditions of each drum and communicating signals representative of such conditions to the transmitter. The transmitter may be configured for wirelessly transmitting such signals to a receiver associated with the remote computer. The remote computer may use such signals representative of such conditions in the generation of the control signals that are sent to the drums.

In some embodiments, a drum lighting system may include at least one drum having a drum head; a trigger assembly engaged with the drum head; a wireless receiver/decoder in communication with the trigger assembly; and at least one LED strip light in communication with the wireless receiver/decoder. The trigger assembly may be configured to generate a trigger signal in response to movement of the drum head. The wireless receiver/decoder may be configured to receive the trigger signal and wireless control signals and control operation of the at least one LED strip light in response to the trigger signal and the control signals.

In some embodiments, a lighted drum system may include (a) a plurality of drums each having a LED strip light, a battery in electrical communication with the LED strip light, and a wireless receiver/decoder in communication with the battery and the LED strip light; and (b) a computer located remote from the plurality of drums and being in wireless communication with the plurality of drums. The computer may be programmed for sending wireless control signals to each of the plurality of drums. Each of the wireless receiver/decoders may be configured to receive the wireless control signals and control operation of the respective LED strip light in response to the control signals.

In some embodiments, a method of controlling lights on a plurality of drums may include (a) providing a plurality of lighted drums, each of the plurality of lighted drums having a LED strip light, a battery in electrical communication with the LED strip light, and a wireless receiver/decoder in communication with the battery and the LED strip light; (b) providing a computer, the computer being located remote from the plurality of drums and being in wireless communication with the wireless receiver/decoder on each of the plurality of drums; and (c) causing the computer to send wireless control signals to each of the plurality of drums; wherein each of the wireless receiver/decoders is configured to receive the wireless control signals and control operation of the respective LED strip light in response to the control signals.

In some embodiments, a drum lighting system may include at least one drum having a drum head, a trigger assembly engaged with the drum head, a wireless receiver/decoder in communication with the trigger assembly, and at least one LED strip light in communication with the wireless receiver/decoder. The trigger assembly may be configured to generate a trigger signal in response to movement of the drum head. The wireless receiver/decoder may be configured to receive the trigger signal and wireless control signals and control operation of the at least one LED strip light in response to the trigger signal and the control signals.

In some embodiments, a method of controlling lights in an artistic performance may include (a) providing a plurality of lighted articles, each of the plurality of lighted articles being disposed on an artistic performer or a prop and comprising a LED strip light, a battery in electrical communication with the LED strip light, and a wireless receiver/decoder in communication with the battery and the LED strip light; (b) providing a computer, the computer being located remote from the plurality of lighted articles and being in wireless communication with the wireless receiver/decoder of each of the plurality of lighted articles; and (c) causing the computer to send wireless control signals to each of the plurality of lighted articles. Each of the wireless receiver/decoders may be configured to receive the wireless control signals and control operation of the respective LED strip light in response to the control signals.

DETAILED DESCRIPTION

Figure 1:
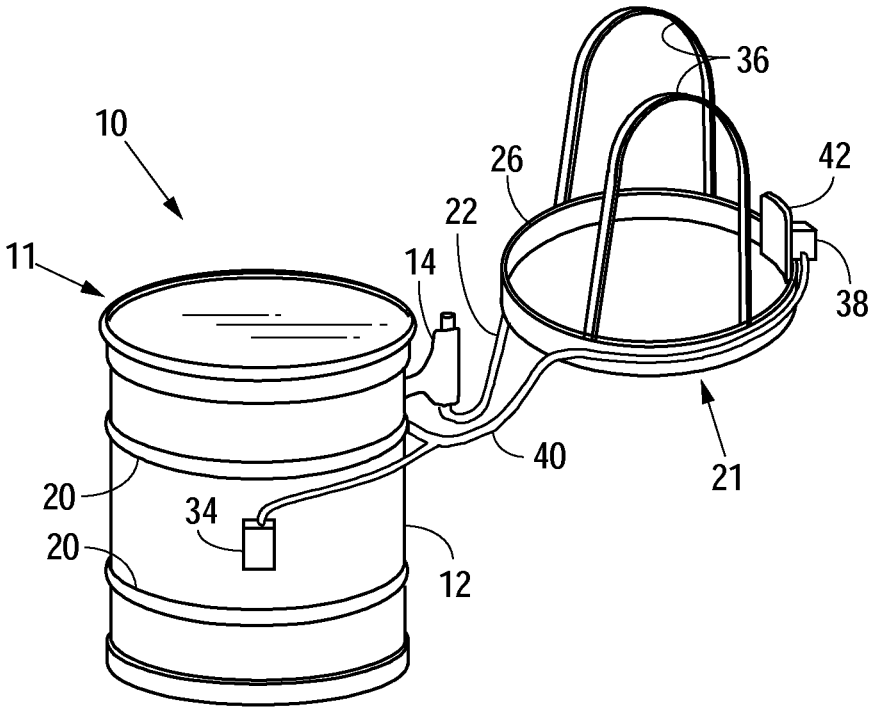
FIG. 1 is a schematic view of a lighted drum and carrier assembly.

As used herein, the following terms should be understood to have the indicated meanings:

When an item is introduced by "a" or "an," it should be understood to mean one or more of that item.

"Battery" means a portable source of electrical power.

"Communication" means the transmission of one or more signals from one point to another point. Communication between two objects may be direct, or it may be indirect through one or more intermediate objects. Communication in and among computers, I/O devices and network devices may be accomplished using a variety of protocols. Protocols may include, for example, signaling, error detection and correction, data formatting and address mapping. For example, protocols may be provided according to the seven-layer Open Systems Interconnection model (OSI model), the TCP/IP model, or any other suitable model.

"Comprises" means includes but is not limited to.

"Comprising" means including but not limited to.

"Computer" means any programmable machine capable of executing machine-readable instructions. A computer may include but is not limited to a general purpose computer, mainframe computer, microprocessor, computer server, digital signal processor, personal computer (PC), personal digital assistant (PDA), laptop computer, desktop computer, notebook computer, smartphone (such as Apple's iPhone™, Motorola's Atrix™ 4G, and Research In Motion's Blackberry™ devices, for example), tablet computer, netbook computer, portable computer, portable media player with network communication capabilities (such as Microsoft's Zune HD™ and Apple's iPod Touch™ devices, for example), camera with network communication capability, wearable computer, point of sale device, or a combination thereof. A computer may comprise one or more processors, which may comprise part of a single machine or multiple machines.

"Computer readable medium" means an article of manufacture having a capacity for storing one or more computer programs, one or more pieces of data, or a combination thereof. A computer readable medium may include but is not limited to a computer memory, hard disk, memory stick, magnetic tape, floppy disk, optical disk (such as a CD or DVD), zip drive, or combination thereof.

"GUI" means graphical user interface.

"Having" means including but not limited to.

"Interface" means a portion of a computer processing system that serves as a point of interaction between or among two or more other components. An interface may be embodied in hardware, software, firmware, or a combination thereof.

"I/O device" may comprise any hardware that can be used to provide information to and/or receive information from a computer. Exemplary I/O devices may include disk drives, keyboards, video display screens, mouse pointers, joysticks, trackballs, printers, card readers, scanners (such as barcode, fingerprint, iris, QR code, and other types of scanners), RFID devices, tape drives, touch screens, cameras, movement sensors, network cards, storage devices, microphones, audio speakers, styli and transducers, and associated interfaces and drivers.

"Memory" may comprise any computer readable medium in which information can be temporarily or permanently stored and retrieved. Examples of memory include various types of RAM and ROM, such as SRAM, DRAM, Z-RAM, flash, optical disks, magnetic tape, punch cards, EEPROM, and combinations thereof. Memory may be virtualized, and may be provided in or across one or more devices and/or geographic locations, such as RAID technology, for example.

"Module" means a portion of a program.

"Network" may comprise a cellular network, the Internet, intranet, local area network (LAN), wide area network (WAN), Metropolitan Area Network (MAN), other types of area networks, cable television network, satellite network, telephone network, public networks, private networks, wired or wireless networks, virtual, switched, routed, fully connected, and any combination and subnetwork thereof. A network may use a variety of network devices, such as routers, bridges, switches, hubs, repeaters, converters, receivers, proxies, firewalls, translators and the like. Network connections may be wired or wireless, and may use multiplexers, network interface cards, modems, ISDN terminal adapters, line drivers, and the like. A network may comprise any suitable topology, such as point-to-point, bus, star, tree, mesh, ring, and any combination or hybrid thereof.

"Program" may comprise any sequence of instructions, such as an algorithm, for example, whether in a form that can be executed by a computer (object code), in a form that can be read by humans (source code), or otherwise. A program may comprise or call one or more data structures and variables. A program may be embodied in hardware, software, firmware, or a combination thereof. A program may be created using any suitable programming language, such as C, C++, Java, Perl, PHP, Ruby, SQL, other languages, and combinations thereof. Computer software may comprise one or more programs and related data. Examples of computer software may include system software (such as operating system software, device drivers and utilities), middleware (such as web servers, data access software and enterprise messaging software), application software (such as databases, video games and media players), firmware (such as software installed on calculators, keyboards and mobile phones), and programming tools (such as debuggers, compilers and text editors).

"Signal" means a detectable physical phenomenon that is capable of conveying information. A signal may include but is not limited to an electrical signal, an electromagnetic signal, an optical signal, an acoustic signal, or a combination thereof.

Figure 2:
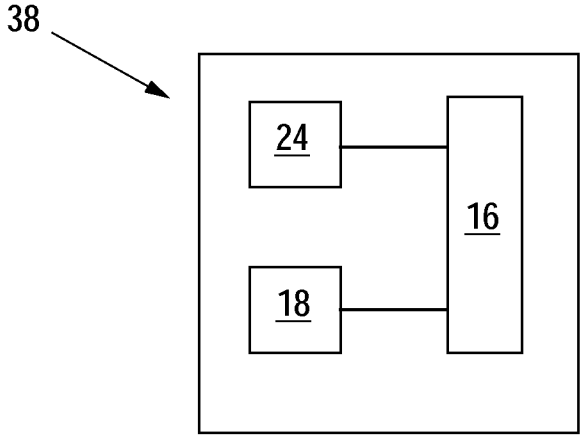
FIG. 2 is a schematic view of an electronics module of the drum and carrier assembly of FIG. 1.

As shown in FIGS. 1 and 2, a lighted drum and carrier assembly 10 may include a drum 11 removably mounted to a carrier 21. For example, carrier 21 may have a rod 22 to which an attachment 14 on drum 11 is removably secured. Carrier 21 may have a waist member 26, a back support 42, and one or more shoulder straps 36, all of which may be adjustable to fit a particular drummer. Drum 11 may have a shell 12 with one or more LED strip lights 20 mounted on it. The LED strip lights 20 may be mounted on an exterior or interior surface of the drum shell 12, for example. Alternatively, the LED strip lights 20 may be mounted to a rim or other component of drum 11. A DMX 512 wireless receiver/decoder 18 and a battery 16 may be provided at a suitable location on drum 11 or carrier 21, such as in an electronics module 38, for example, which may be mounted to drum 11 or carrier 21. For example, in some embodiments, electronics module 38 may be provided on back support 42 in order to reduce the weight of drum 11 and thereby make it more comfortable to carry. Drum shell 12 may be opaque or it may be made of transparent or translucent material, such as polycarbonate, for example, or other suitable material. The battery 16 may provide electrical power to the DMX 512 receiver/decoder 18, the LED strip lights 20, a transmitter 24, and one or more sensors 34 described further below, via electrical wires (such as wire 40) or other suitable electrical communication.

Figure 3:
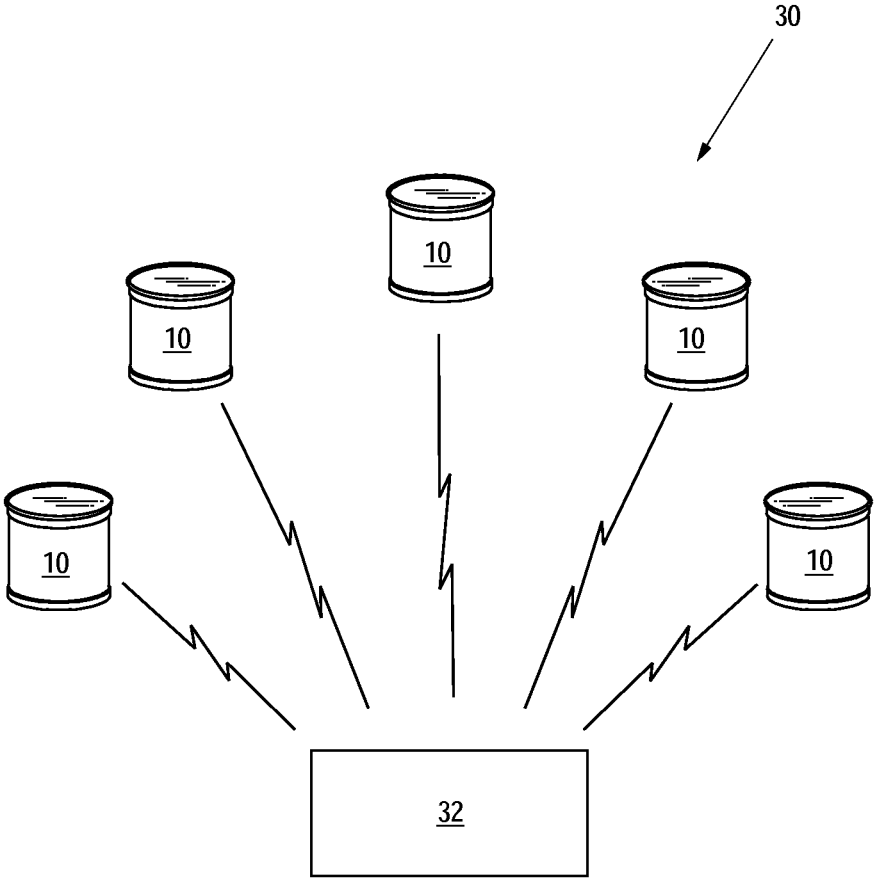
FIG. 3 is a schematic diagram of a system for controlling one or more LED strip lights of one or more lighted drums.

The DMX 512 receiver/decoder 18 may receive wireless control signals from a remote computer 32 (see FIG. 3), such as a DMX 512 wireless controller, which may be configured as part of a system 30 to control the LED strip lights 20 in a plurality of such lighted drum and carrier assemblies 10. For example, the remote computer 32 may turn the LED lights on and off, change the color of the lights, change the brightness of the lights, cause the lights to flash or fade, and the like. Such control and changes may be made to the various lighted drum and carrier assemblies 10 in unison, in groups, or separately. Computer 32, which may be located some distance away from the lighted drum and carrier assemblies 10 such as on a sideline or in a press box, for example, may have one or more memories programmed with one or more programs on one or more computer readable media, one or more I/O devices, one or more GUI's, one or more receivers for receiving wireless signals from lighted drum and carrier assemblies 10, and one or more transmitters for sending wireless signals to lighted drum and carrier assemblies 10 in accordance with the programs. Although only one computer 32 is shown, two or more such computers may be employed, depending on the needs of the particular application.

In some embodiments, a lighted drum and carrier assembly 10 may have one or more sensors 34 that detect various conditions and provide data representative of those conditions to a wireless transmitter 24 for transmission of such data to computer 32. Transmitter 24 may be part of DMX 512 wireless receiver/decoder 18, for example, or a separate component. For example, sensors 34 may include a GPS sensor for sensing the geographic location of lighted drum and carrier assembly 10, a magnetometer for sensing the orientation of lighted drum and carrier assembly 10, an accelerometer for sensing the linear or angular acceleration of lighted drum and carrier assembly 10, or any other suitable sensor for sensing a desired condition. The data from sensors 34 may be transmitted by transmitter 24 to a receiver associated with computer 32, which may receive such data as input and calculate control signals based on such data, and such control signals may be transmitted to the DMX 512 wireless receiver/decoder 18 of the appropriate lighted drum and carrier assembly 10 by a transmitter associated with computer 32.

As persons of ordinary skill in the art will appreciate, a system 30 of lighted drum and carrier assemblies 10 as described herein may be employed to achieve a variety of dramatic effects. For example, each of the drummers in a marching band may carry a lighted drum and carrier assembly 10 and may march, sway, or otherwise manipulate the lighted drum and carrier assembly 10 in a choreographed routine of various motions. The one or more computers 32 may be programmed to control the LED strip lights 20 in the various lighted drum and carrier assemblies 10 during the choreographed routine in order to create an enhanced visual effect for an audience. For example, various color patterns, designs, and light sequences may be formed by varying the color, intensity, duration, or other characteristic of light emitted from the various lighted drum and carrier assemblies 10 during the routine. Such characteristics of the light emitted from the various lighted drum and carrier assemblies 10 may be varied as a function of one or more variables, such as the location of each lighted drum and carrier assembly 10 on the performance venue (e.g., football field or basketball court), the particular time during the routine, the orientation of each lighted drum and carrier assembly 10, the linear or angular velocity or acceleration of each lighted drum and carrier assembly 10, or any other desired variable. The remote control of the LED strip lights 20 by the one or more computers 32 as described herein does not impose any additional performance burden on the drummers, because they need not worry about operating any switches or other control mechanisms on the lighted drum and carrier assemblies 10 and thus are free to focus on the routine.

Figure 4:
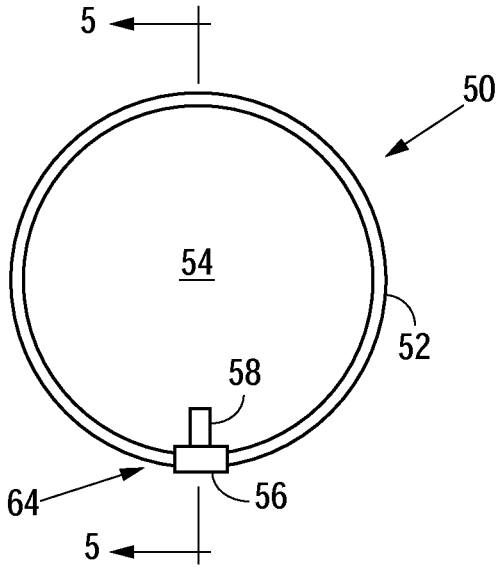
FIG. 4 is a plan view of a drum and trigger assembly.
Figure 5:
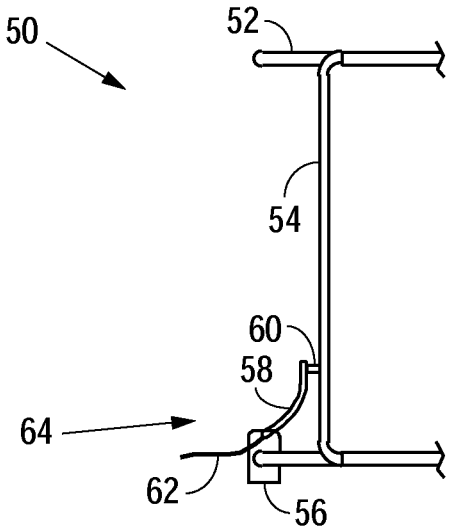
FIG. 5 is a partial cross sectional view of the drum and trigger assembly of FIG. 4.
Figure 6:
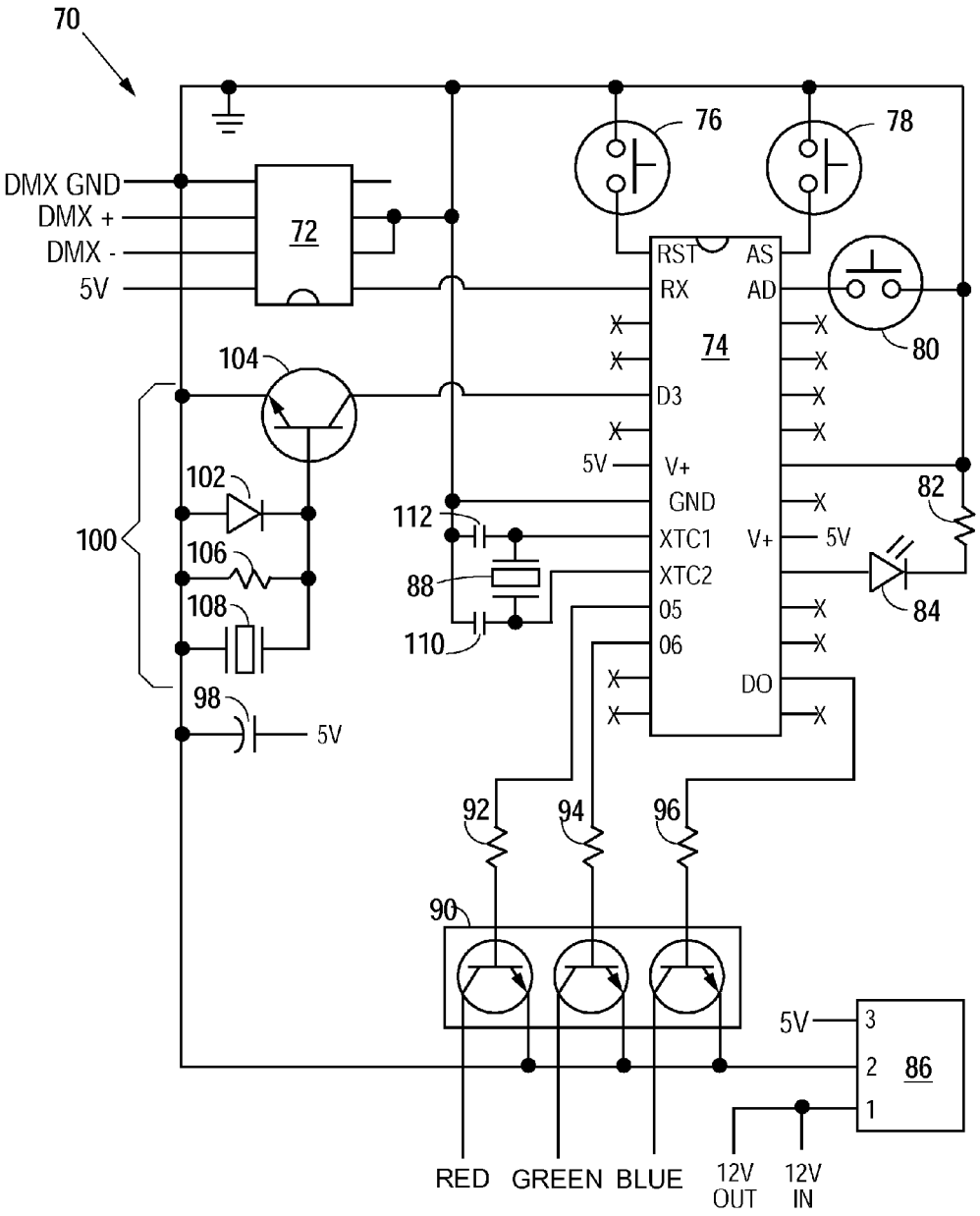
FIG. 6 is a schematic diagram of a DMX receiver/decoder.

In some embodiments, as shown in FIGS. 4 and 5, a drum 50 may be equipped with a trigger assembly 64 that may be configured to activate one or more LED strip lights 20 provided on drum 50 (similar to drum 11 described above) upon striking of a drum head 54 of drum 50. Trigger assembly 64 may be mounted to a rim or shell 52 of drum 50 via a suitable attachment 56, such as a clamp, for example. Trigger assembly 64 may include a piezoelectric sensor 58 having a pad 60 engaged with a surface of drum head 54, and a wire 62 or wireless signal may connect piezoelectric sensor 58 to a DMX 512 receiver/decoder, such as DMX 512 receiver/decoder 70 shown in FIG. 6, for example. Of course, in addition to or in lieu of piezoelectric sensor 58, any suitable sensor may be used for trigger assembly 64 that is responsive to movement of drum head 54. DMX 512 receiver/decoder 70 may be in communication with battery 16, LED strip lights 20, and computer 32 (e.g., DMX 512 controller) as described above for DMX 512 receiver/decoder 18, for example. Computer 32 and DMX 512 receiver/decoder 70 may be programmed to operate one or more LED strip lights 20 as described herein. Persons of ordinary skill in the art will appreciate that various portions of the applicable programming code may reside on computer 32 and/or DMX 512 receiver/decoder 70, depending on the particular application. By way of nonlimiting example, sample Arduino-based C++ software code for DMX 512 receiver/decoder 70 is provided in the attached Appendix, which is incorporated herein by reference.

In some embodiments, when a user strikes drum head 54 (or another drum head or portion of drum 50), the motion of drum head 54 may cause piezoelectric sensor 58 to flex, which may produce a signal that may be sent from piezoelectric sensor 58 to DMX 512 receiver/decoder 70 and/or computer 32, which in turn may cause the associated LED strip lights 20 to illuminate. Piezoelectric sensor 58 may be calibrated to trigger the illumination of LED strip lights 20 in this manner upon the occurrence of a predetermined amount of motion of drum head 54, which may correspond to the application of a certain level of impact force on drum head 54 or another drum head or portion of drum 50 by a user, whether by a drum stick, mallet, finger, hand, or other striking instrument. The colors and other characteristics of light emitted by LED strip lights 20 when triggered may be controlled by computer 32 and/or DMX 512 receiver/decoder 70.

In some embodiments, the amount of flexure (corresponding to level of impact force) detected by piezoelectric sensor 58 may be provided as input to computer 32, and the amount of flexure may be used by computer 32 to determine a characteristic of light to be produced by LED strip lights 20. For example, the intensity or duration of the light emitted by LED strip lights 20 may be directly or inversely proportional (or bear any other desired relationship) to the amount of flexure of piezoelectric sensor 58 (e.g, the amplitude of the trigger signal generated by trigger assembly 64). Alternatively or additionally, the color of the light emitted by LED strip lights 20 may be determined by the amount of flexure of piezoelectric sensor 58. For example, the frequency of light emitted by LED strip lights 20 may be directly or inversely proportional (or bear any other desired relationship) to the amount of flexure of piezoelectric sensor 58; or, a first color of light may be produced by an amount of flexure falling within a first range of flexure, a second color of light may be produced by an amount of flexure falling within a second range of flexure, and so on.

Referring again to FIG. 6, in some embodiments, DMX 512 receiver/decoder 70 may include a DMX transceiver 72, such as a Maxim MAX 485™ DMX transceiver available from Maxim Integrated (San Jose, Calif.), for example, arranged on a circuit board as shown. In some embodiments, only the receive function of DMX transceiver 72 may be utilized, e.g., to receive input signals from computer 32 (e.g., DMX 512 wireless controller, see FIG. 7), or a DMX receiver may be used. In other embodiments, both the receive function and the transmit function of DMX transceiver 72 may be utilized. DMX 512 receiver/decoder 70 may also include a microcontroller 74, such as an Atmel ATMEGA 328P-PU™ microcontroller available from Atmel (San Jose, Calif.), for example; a power transistor array 90, such as a Sanken STA 412A™ power transistor array available from SanKen Electric Co. (Kitano, Japan), for example; a crystal oscillator 88 (e.g., 16 MHz) to provide a clock signal for the circuitry; and a voltage regulator 86 to regulate the voltage for the circuitry. For example, in the embodiment shown in FIG. 6, 12-volt input may be regulated down to 5-volt operating voltage for the circuitry. DMX 512 receiver/decoder 70 may also include trigger circuitry 100 including a NPN transistor 104, a diode 102 to rectify input and provide positive voltage to NPN transistor 104, a resistor 106, a piezoelectric sensor 108, and a capacitor 98. Trigger circuitry 100 may be configured to receive input signals from trigger 64 (see FIGS. 4 and 5) and pass an appropriate trigger signal to microcontroller 74. Additional capacitors 110 and 112 may be provided in order to stabilize the crystal oscillator 88, and a resistor 82 and light-emitting diode 84 may be provided in order to indicate various states of operation. Additional resistors 92, 94, 96 may be provided between power transistor array 90 and microcontroller 74 in order to regulate signal current to power transistor array 90. Contact switches 78 and 80 may be provided to facilitate programming of microcontroller 74, and a reset switch 76 may be provided to reset the circuit in the event of a malfunction. DMX 512 receiver/decoder 70 may be operated in conjunction with one or more drums 50 and computer 32 in order to control one or more LED strip lights 20 as described herein. Although exemplary circuitry is illustrated for DMX 512 receiver/decoder 70 in FIG. 6, persons of ordinary skill in the art will understand that many alternative forms of circuitry may be used, depending on the particular application.

Figure 7:
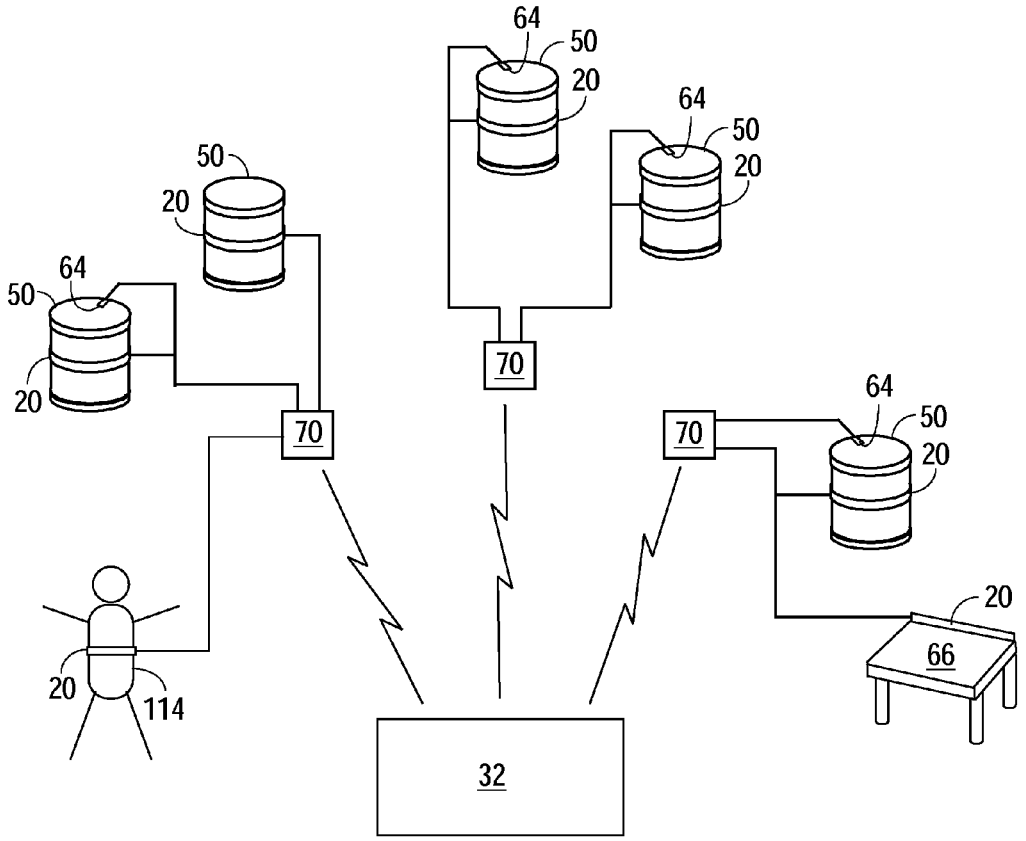
FIG. 7 is a schematic diagram of a system for controlling one or more LED strip lights associated with one or more drums or other objects.

Referring to FIG. 7, in some embodiments, rather than (or in addition to) being mounted on drum 50, the associated LED strip lights 20 triggered by trigger assembly 64 may be mounted to some other structure, such as a performance stage structure or prop 66 or a performer's clothing or other wearable article 114, for example. In some embodiments, computer 32 may be programmed to control LED strip lights 20 associated with multiple drums 50 or trigger assemblies 64. A given trigger assembly 64 may be used to trigger illumination of one or multiple LED strip lights 20 and/or zones of LED strip lights 20, which may be arranged in any desirable pattern or design. In some embodiments, the one or more LED strip lights 20 or zones of LED strip lights 20 triggered by a trigger assembly 64 may be subject to a specified time delay and/or a specified sequence of lighting characteristics (e.g., colors, durations, intensities, or the like). In some embodiments, multiple trigger assemblies 64 may be in communication with the same DMX 512 receiver/decoder 70. In some embodiments, the various electronic components described herein (e.g., DMX 512 receiver/decoder 18 or 70, trigger assembly 64, LED strip lights 20, computer 32, transmitter 24, sensors 34) may be powered by one or more mobile power sources such as a battery; alternatively, some or all of such components may be powered by one or more fixed power sources. Additionally, in some embodiments, one or more LED strip lights 20 may or may not be triggered by a trigger assembly 64 and may be controlled alternatively or entirely by computer 32 in cooperation with DMX 512 receiver/decoder 18 or 70. In some embodiments in which one or more LED strip lights 20 are disposed on or in a person's clothing or other wearable article 114, the other associated power and electronic components (e.g., DMX 512 receiver/decoder 18 or 70, trigger assembly 64, transmitter 24, sensors 34, battery 16, and the like) may also be worn by the person, and the associated DMX 512 receiver/decoder 18 or 70 and transmitter 24 may be in wireless communication with computer 32 as described above.

The embodiments described above are some examples of the current invention. Various modifications and changes of the current invention will be apparent to persons of ordinary skill in the art. Among other things, any feature described for one embodiment may be used in any other embodiment, and methods described and shown in the figures may be combined. In addition, the order of steps shown in the figures and described above may be changed in different embodiments. For example, although DMX 512 wireless receiver/decoder 18, battery 16, and transmitter 24 are illustrated as being mounted to carrier 21, in some embodiments all of such components may be mounted on or in drum 11. The scope of the invention is defined by the claims that may be drawn to this invention, considering the doctrine of equivalents, and is not limited to the specific examples described herein.

APPENDIX

Action Loop code

```
unsigned long flashTime;

void action() {
  /*********** Put what you want the code to do with the values (dmxvalue)
here *************
   * example code: print out the received values to the serial port, and
set PWM pins 5 and 6
   to the first two values received.  You can take this code out and put
your own in.*/

  if(dmxvalue[3] < 127){
    digitalWrite(13, LOW);
    analogWrite(5, dmxvalue[0]);
    analogWrite(6, dmxvalue[1]);
    analogWrite(10, dmxvalue[2]);
  }
  if(dmxvalue[3] >= 127) {
    digitalWrite(13, HIGH);
    if(flash == true){
      flash = false;
      flashTime = millis() + 50;
    }
    if(millis() <= flashTime){
      analogWrite(5, dmxvalue[0]);
      analogWrite(6, dmxvalue[1]);
      analogWrite(10, dmxvalue[2]);
    }
    else{
      analogWrite(5, 0);
      analogWrite(6, 0);
      analogWrite(10, 0);
    }
```

```
  }

  return;  //go back to loop()
} //end action() loop
```

---

Addressing code

```
unsigned int Addressing() {
  //the switch states for the 1 and 0 pin
  byte switch1 = digitalRead(SWITCH_PIN_1);
  byte switch0 = digitalRead(SWITCH_PIN_0);


  //Case 1: Neither switch is pressed.
  if (switch0 == HIGH && switch1 == HIGH) {
    //read the previously stored value from EEPROM addresses 510 and 511.
    dmxaddress = EEPROM.read(511);   //read the high byte into dmxaddress
    dmxaddress = dmxaddress << 8;
    //bitshift the high byte left 8 bits to make room for the low byte
    dmxaddress =  dmxaddress | EEPROM.read(510);    //read the low byte
into dmxaddress
    //check for unitialized EEPROM
    if (dmxaddress > 511 || dmxaddress < 1) dmxaddress == 1;
  }

  //Case 2: Both switches are pressed, address is reset to 1.
  else if (switch0 == LOW && switch1 == LOW)
  {
    dmxaddress = 1;
    newAddressWrite();
  }

  //Case 3: One switch is pressed, but not the other.
  else if (switch0 == 0 ^ switch1 == 0)
```

```
  {
    /* if EITHER switch0 or switch1 is held down (but not both), the
addressing subroutine is
     * run. Since it writes the new address into EEPROM, there's no need
to pass anything
     * back to the main function. */
    digitalWrite(13, HIGH); //turn on pin 13 to indicate addressing mode
    //do nothing until the switch is released
    while (switch0 == LOW || switch1 == LOW) {
      switch0 = digitalRead(SWITCH_PIN_0);
      switch1 = digitalRead(SWITCH_PIN_1);
    }
    delay(50);

    char bitnumber = 8; //The current bit to be recorded. Now entered MSB
first.
    //runs until all 9 bits have been recorded into the address.
    while (bitnumber >= 0) {
      //first, make sure both switches are released before accepting new
bit.
      if (switch0 == LOW || switch1 == LOW) {
        digitalWrite(13, LOW); //flash off pin 13 to indicate bit accepted
        //remain in the while loop while either switch is pressed, then
delay half a second to avoid bounce and signal to the user that the bit
has been accepted.
        while (switch0 == LOW || switch1 == LOW) {
          switch0 = digitalRead(SWITCH_PIN_0);
          switch1 = digitalRead(SWITCH_PIN_1);
        }
        delay(500);
      }//end if

      //The switches have been released, now wait for the new bit.
      digitalWrite(13, HIGH); //turn on pin 13 to indicate ready for new
bit.
      switch0 = digitalRead(SWITCH_PIN_0);
```

```
      switch1 = digitalRead(SWITCH_PIN_1);
      if (switch1 == LOW) {//execute if 1 pin is pressed
        bitSet(dmxaddress, bitnumber);  //write a 1 to the appropriate bit
of dmxaddress
        bitnumber--;
      }
      else if (switch0 == LOW) {//execute if 0 pin is pressed
        bitClear(dmxaddress, bitnumber);
        bitnumber--;
      }
    } //end while loop
    //write the new address to EEPROM
    newAddressWrite();
  }//end else if addressing subroutine


    dmxaddress = dmxaddress + 3;
  /*  this will allow the USART receive interrupt to fire an additional 3
times for every dmx frame.
   *   Here's why:
   *    Once to account for the fact that DMX addresses run from 0-511,
whereas channel numbers
   *        start numbering at 1.
   *   Once for the Mark After Break (MAB), which will be detected by the
USART as a valid character
   *        (a zero, eight more zeros, followed by a one)
   *   Once for the START code that precedes the 512 DMX values (used for
RDM).  */

  return dmxaddress;
}  //end Addressing()



void newAddressWrite() {
```

```
  EEPROM.write(510,  lowByte(dmxaddress));//writes  the  first  byte  of
dmxaddress to EEPROM address 510
  EEPROM.write(511,  highByte(dmxaddress));//writes  the  second  byte  of
dmxaddress to EEPROM address 511

  for (byte i = 0; i < 15; i++) { //blink LED 4 times when new address is
received.
    digitalWrite(13, (i & 1));
    //i & 1 will bitwise-and to 1 if i is odd, 0 if even.
    delay(100);
  }

}
```

---

Receiver code

```
/*******************************     Output     variable     declarations
****************************/

#define LEDPIN A3
#define RED 5
#define GREEN 6
#define BLUE 10

#define MIC 3

volatile byte flash = false;

/*******************************    Addressing    variable    declarations
****************************/

#include <EEPROM.h>
#define NUMBER_OF_CHANNELS 4
//the number of channels we want to receive (8 by default).
```

```
#define SWITCH_PIN_0 A4 //the pin number of our "0" switch
#define SWITCH_PIN_1 A5 //the pin number of our "1" switch
unsigned int dmxaddress = 1;
/* The dmx address we will be listening to.  The value of this will be set
in the Addressing()
*  function and read from EEPROM addresses 510 and 511.

/******************************     MAX485     variable     declarations
****************************/

#define RECEIVER_OUTPUT_ENABLE 7
/* receiver output enable (pin2) on the max485.
*  will be left low to set the max485 to receive data. */

#define DRIVER_OUTPUT_ENABLE 8
/* driver output enable (pin3) on the max485.
*  will left low to disable driver output. */

#define RX_PIN 0    // serial receive pin, which takes the incoming data
from the MAX485.
#define TX_PIN 1   // serial transmission pin

/*******************************      DMX      variable      declarations
*******************************/

volatile byte i = 0;              //dummy variable for dmxvalue[]
volatile byte dmxreceived = 0;    //the latest received value
volatile unsigned int dmxcurrent = 0;       //counter variable that is
incremented every time we receive a value.
volatile byte dmxvalue[NUMBER_OF_CHANNELS];
/*  stores the DMX values we're interested in using--
 *  keep in mind that this is 0-indexed. */
volatile boolean dmxnewvalue = false;
/*  set to 1 when updated dmx values are received
 *  (even if they are the same values as the last time). */
```

```
/*******************************     Timer2     variable     declarations
****************************/

volatile byte zerocounter = 0;
/* a counter to hold the number of zeros received in sequence on the
serial receive pin.
*  When we've received a minimum of 11 zeros in a row, we must be in a
break.  */




void setup() {

  /*******************************          Max485          configuration
***********************************/

  pinMode(RECEIVER_OUTPUT_ENABLE, OUTPUT);
  pinMode(DRIVER_OUTPUT_ENABLE, OUTPUT);
  digitalWrite(RECEIVER_OUTPUT_ENABLE, LOW);
  digitalWrite(DRIVER_OUTPUT_ENABLE, LOW);     //sets pins 3 and 4 to low
to enable reciever mode on the MAX485.

  pinMode(RX_PIN, INPUT);  //sets serial pin to receive data

  /*******************************      Output      pin      configuration
****************************/

  pinMode(RED, OUTPUT);
  pinMode(GREEN, OUTPUT);
  pinMode(BLUE, OUTPUT);
  pinMode(LEDPIN, OUTPUT);

  pinMode(MIC, INPUT_PULLUP);
  attachInterrupt(1, hitReceived, FALLING);
```

```
  /******************************          Addressing          subroutine
********************************/

  pinMode(SWITCH_PIN_0, INPUT);             //sets pin for '0' switch to
input
  digitalWrite(SWITCH_PIN_0, HIGH);        //turns on the internal pull-up
resistor for '0' switch pin
  pinMode(SWITCH_PIN_1, INPUT);             //sets pin for '1' switch to
input
  digitalWrite(SWITCH_PIN_1, HIGH);        //turns on the internal pull-up
resistor for '1' switch pin
  pinMode(13, OUTPUT);
  digitalWrite(13, LOW);
  /* Call the addressing subroutine.  Three behaviors are possible:
  *   1. Neither switch is pressed, in which case the value previously
stored in EEPROM
  *  510 and 511 is recalled,
  *   2. Both switches are pressed, in which case the address is reset to
1.
  *   3. Either switch is pressed (but not both), in which case the new
address may
  *  be entered by the user.
  */
  //set this equal to a constant value if you just want to hardcode the
address.
  dmxaddress = Addressing();
  /******************************          USART          configuration
************************************/

  Serial.begin(250000);
  /* Each bit is 4uS long, hence 250Kbps baud rate */

  cli(); //disable interrupts while we're setting bits in registers
```

```
  bitClear(UCSR0B, RXCIE0);  //disable USART reception interrupt

  /*******************************          Timer2          configuration
*********************************/

  //NOTE:  this will disable PWM on pins 3 and 11.
  bitClear(TCCR2A, COM2A1);
  bitClear(TCCR2A, COM2A0); //disable compare match output A mode
  bitClear(TCCR2A, COM2B1);
  bitClear(TCCR2A, COM2B0); //disable compare match output B mode
  bitSet(TCCR2A, WGM21);
  bitClear(TCCR2A, WGM20);  //set mode 2, CTC.  TOP will be set by OCRA.

  bitClear(TCCR2B, FOC2A);
  bitClear(TCCR2B, FOC2B);  //disable Force Output Compare A and B.
  bitClear(TCCR2B, WGM22);  //set mode 2, CTC.  TOP will be set by OCRA.
  bitClear(TCCR2B, CS22);
  bitClear(TCCR2B, CS21);
  bitSet(TCCR2B, CS20);    // no prescaler means the clock will increment
every 62.5ns (assuming 16Mhz clock speed).

  OCR2A = 64;
  /* Set output compare register to 64, so that the Output Compare
Interrupt will fire
  *  every 4uS.  */

  bitClear(TIMSK2, OCIE2B);  //Disable Timer/Counter2 Output Compare Match
B Interrupt
  bitSet(TIMSK2, OCIE2A);     //Enable Timer/Counter2 Output Compare Match
A Interrupt
  bitClear(TIMSK2, TOIE2);    //Disable Timer/Counter2 Overflow Interrupt
Enable

  sei();                        //reenable interrupts now that timer2 has
been configured.
```

```
}  //end setup()


void loop()  {
  // the processor gets parked here while the ISRs are doing their thing.

  if (dmxnewvalue == 1) {    //when a new set of values are received, jump
to action loop...
    action();
    dmxnewvalue = 0;
    dmxcurrent = 0;
    zerocounter = 0;        //and then when finished reset variables and
enable timer2 interrupt
    i = 0;
    bitSet(TIMSK2, OCIE2A);       //Enable Timer/Counter2 Output Compare
Match A Interrupt
  }
} //end loop()


//Timer2 compare match interrupt vector handler
ISR(TIMER2_COMPA_vect) {
  if (bitRead(PIND, PIND0)) {  // if a one is detected, we're not in a
break, reset zerocounter.
    zerocounter = 0;
    }
  else {
    zerocounter++;                 // increment zerocounter if a zero is
received.
    if (zerocounter == 20)      // if 20 0's are received in a row (80uS
break)
      {
      bitClear(TIMSK2, OCIE2A);      //disable this interrupt and enable
reception interrupt now that we're in a break.
      bitSet(UCSR0B, RXCIE0);
      }
```

```
  }
} //end Timer2 ISR



ISR(USART_RX_vect){
  dmxreceived = UDR0;
  /* The receive buffer (UDR0) must be read during the reception ISR, or
the ISR will just
  *  execute again immediately upon exiting. */

  dmxcurrent++;                        //increment address counter

  if(dmxcurrent > dmxaddress) {          //check if the current address is
the one we want.
    dmxvalue[i] = dmxreceived;
    i++;
    if(i == NUMBER_OF_CHANNELS) {
      bitClear(UCSR0B, RXCIE0);
      dmxnewvalue = 1;                        //set newvalue, so that the
main code can be executed.
    }
  }
} // end ISR

void hitReceived(){
  flash = true;
}
```

What is claimed is:

1. A lighted drum comprising:

a drum;

a LED strip light disposed on said drum;

a battery in electrical communication with said LED strip light;

a wireless receiver/decoder in communication with said battery and said LED strip light;

wherein said wireless receiver/decoder is configured to receive wireless control signals and control operation of said LED strip light in response to said control signals;

a sensor disposed on said drum;

wherein said sensor is selected from GPS sensor, magnetometer, accelerometer, and a combination thereof; and a transmitter in communication with said sensor;

said sensor being configured for sensing a condition of said drum and communicating a signal representative of said condition to said transmitter;

said transmitter being configured for wirelessly transmitting said signal to a receiver associated with a remote computer.

2. The drum of claim 1 wherein said battery and said wireless receiver/decoder are disposed on a drum carrier to which said drum is removably attached.

3. The drum of claim 1 wherein said condition is selected from location, orientation, velocity, acceleration, and a combination thereof.

4. A lighted drum system comprising:

(a) a plurality of drums each comprising a LED strip light;

a battery in electrical communication with said LED strip light;

a wireless receiver/decoder in communication with said battery and said LED strip light; and (b) a computer located remote from said plurality of drums and being in wireless communication with said plurality of drums, said computer being programmed for sending wireless control signals to each of said plurality of drums;

wherein each of said wireless receiver/decoders is configured to receive said wireless control signals and control operation of the respective LED strip light in response to said control signals;

wherein at least one of said plurality of drums further comprises a transmitter and a sensor configured for sensing a condition of said at least one drum and communicating a condition signal representative of said condition to said transmitter;

wherein said transmitter is configured for wirelessly transmitting said condition signal to a receiver associated with said computer;

wherein said computer is configured for generating said control signals at least in part based on said condition signal; and wherein at least some of said control signals are configured for controlling a characteristic of light emitted from one or more of said LED strip lights in response to said condition signal.

5. The system of claim 4 wherein said characteristic is selected from color, intensity, duration, and a combination thereof.

6. The system of claim 5 wherein said characteristic is varied as a function of one or more variables.

7. The system of claim 6 wherein said one or more variables includes a time.

8. The system of claim 6 wherein said condition is selected from location, orientation, velocity, acceleration, and a combination thereof.

9. A method of controlling lights on a plurality of drums, comprising:

(a) providing a plurality of lighted drums, each of said plurality of lighted drums comprising a LED strip light;

a battery in electrical communication with said LED strip light; and a wireless receiver/decoder in communication with said battery and said LED strip light;

(b) providing a computer, said computer being located remote from said plurality of drums and being in wireless communication with said wireless receiver/decoder on each of said plurality of drums;

(c) measuring, using a sensor attached to at least one of said plurality of lighted drums, a condition signal representative of a condition of said at least one of said plurality of lighted drums;

(d) sending said condition signal to said computer; and (e) causing said computer to send wireless control signals to each of said plurality of drums;

wherein said sensor is selected from GPS sensor, magnetometer, accelerometer, and a combination thereof;

wherein said wireless control signals are at least in part based on said condition signal;

wherein each of said wireless receiver/decoders is configured to receive said wireless control signals and control operation of the respective LED strip light in response to said control signals.

10. A drum lighting system comprising:

at least one drum comprising a drum head;

a trigger assembly engaged with said drum head;

a wireless receiver/decoder in communication with said trigger assembly; and at least one LED strip light in communication with said wireless receiver/decoder;

wherein said trigger assembly is configured to generate a trigger signal in response to movement of said drum head;

wherein said wireless receiver/decoder is configured to receive said trigger signal and wireless control signals and control operation of said at least one LED strip light in response to said trigger signal and said control signals;

wherein said trigger assembly comprises a piezoelectric sensor configured for sensing an amount of flexure of said drum head; and at least some of said control signals are configured for controlling a characteristic of light emitted from said at least one LED strip light in response to said amount of flexure.

11. The system of claim 10 wherein said at least one LED strip light is mounted on said at least one drum.

12. The system of claim 10 further comprising a computer located remote from said at least one drum, said computer being in wireless communication with said wireless receiver/decoder and configured to generate said control signals.

13. The system of claim 10 wherein said characteristic is proportional to said amount of flexure.

14. The system of claim 10 wherein said characteristic comprises a first color of light if said amount of flexure falls within a first range of flexure, and wherein said characteristic comprises a second color of light if said amount of flexure falls within a second range of flexure.

* * * * *